US007042412B2

(12) United States Patent
Chuang

(10) Patent No.: US 7,042,412 B2
(45) Date of Patent: May 9, 2006

(54) PRINTED DUAL DIPOLE ANTENNA

(75) Inventor: Huey-Ru Chuang, Tainan (TW)

(73) Assignee: Mediatek Incorporation, Hsinchu (TW)

( * ) Notice: Subject to any disclaimer, the term of this patent is extended or adjusted under 35 U.S.C. 154(b) by 48 days.

(21) Appl. No.: 10/860,213

(22) Filed: Jun. 3, 2004

(65) Prior Publication Data

US 2004/0252070 A1 Dec. 16, 2004

Related U.S. Application Data

(60) Provisional application No. 60/478,569, filed on Jun. 12, 2003.

(51) Int. Cl.
*H01Q 9/28* (2006.01)

(52) U.S. Cl. ..... 343/795

(58) Field of Classification Search ..... 343/795
See application file for complete search history.

(56) References Cited

U.S. PATENT DOCUMENTS

| | | | | |
|---|---|---|---|---|
| 4,044,303 | A * | 8/1977 | Reindel | 324/95 |
| 5,532,708 | A * | 7/1996 | Krenz et al. | 343/795 |
| 6,249,260 | B1 * | 6/2001 | Holloway | 343/795 |
| 6,480,166 | B1 * | 11/2002 | Tsai et al. | 343/795 |
| 6,639,555 | B1 * | 10/2003 | Kane et al. | 343/700 MS |
| 6,940,470 | B1 * | 9/2005 | Nesic et al. | 343/895 |
| 2004/0140941 | A1 * | 7/2004 | Joy et al. | 343/795 |

* cited by examiner

*Primary Examiner*—Tho Phan
(74) *Attorney, Agent, or Firm*—J.C. Patents

(57) ABSTRACT

A printed dual dipole antenna is disposed in a specific region with a border on a PCB having a first surface and a second surface. The printed dual dipole antenna has a first split dipole antenna along a first operation direction. The first split dipole antenna includes a balun member, a first antenna branch, and a second antenna branch on the first surface of the PCB, and a signal feeding member on the second surface of the PCB. Wherein, at least one of the first antenna branch and the second antenna branch is bent into a bent structure to fit within the specific region. A second split dipole antenna along a second operation direction. Wherein, at least one of the first antenna branch and the second antenna branch is bent into a bent structure to fit within the specific region.

19 Claims, 3 Drawing Sheets

PRINTED DUAL DIPOLE ANTENNA

CROSS-REFERENCE TO RELATED APPLICATION

This application claims the priority benefit of U.S. provisional application titled "PRINTED DUAL DIPOLE ANTENNA" filed on Jun. 12, 2003, Ser. No. 60/478,569.

BACKGROUND OF THE INVENTION

1. Field of Invention

The present invention relates to wireless communication technology. More particularly, the present invention relates to a planar dual printed dipole-antenna with integrated via-hole balun and pattern diversity-switching circuit suitable for 2.4 GHz wireless applications.

2. Description of Related Art

Antenna in wireless communication is the necessary component to transmit and receive the radio frequency (RF) signals. The actual design of the antenna for the various applications may be very different, depending on, i.e., the transmission range and power. However, a dipole antenna in design principle is quite common in various applications. For example, the cellular phone needs a small antenna to transmit and receive RF signals. In order to have small size of the cellular phone, the conventional technique has implemented the dipole antenna directly on a printed circuit board (PCB).

The printed antenna is conventionally formed on a PCB. For example, the printed dipole antenna usually is formed on a two-side PCB. On one side of the PCB, a conventional T-like dipole antenna, or split dipole antenna, is formed thereon. The T-like dipole antenna employs a balun mechanism. The balun mechanism is for transforming the RF signal between a balance state and an unbalance state, as well known in the prior art. Then, a conductive strip, serving as an antenna feed, is formed on the other side of the PCB, so as to couple to the T-like dipole antenna. RF signals are fed from the conductive strip. Through the coupling mechanism between the conductive strip and the dipole antenna, the signal is transmitted.

In FIG. 1, the conventional T-like dipole antenna is shown from a top view of a PCB. The dipole antenna 100 is formed on a PCB. Here, the PCB, as understood by the skilled artisans, is omitted in the drawing. As well known by the skilled artisans, the antenna usually is operated between a balance mode and unbalance mode, a balance/unbalance (balun) member 108 like a U shape is used. The balun member 108 typically includes a main balun part 104 in two bars and a connection part 106 to connect the two bars from one end. Two antenna branches 100*a*, 100*b* are coupled to the balun member 108. The conductive strip 102 is formed on the other side of the PCB. A part of the conductive strip 102 is along one branch 100*a* of the T-like dipole antenna. However, the end of the conductive strip 102 can, for example, be directly coupled to the other branch 100*b* by a interconnecting plug through the PCB, as shown by a small circle. The area 90 of the PCB is a circuit area 90. The circuit area 90 also includes a ground layer (not shown). The RF signals can be fed to the conductive strip 102. Due to the balun member 108, the unbalance RF signal fed from the conductive strip 102, that is, signal feeding member 102 is converted into a balance signal, transmitted by the two antenna branches 100*a*, 100*b*.

In a wireless communication system, the antenna is formed on the PCB for reducing the apparatus dimension. In some communication interfaces, such as PCMCIA or card bus, two dipole antennas are required for switching between them in use. The antenna size needs to match to a factor of the wavelength of the RF signal. Usually, it is ¼ wavelength. However, if two dipole antennas are formed on the PCB, it then consumes a certain portion of the available area. When the size of a wireless communication device, such as the mobile phone, is greatly reduced, the antenna then occupies a relatively large portion of the available area. It causes the difficulty to implement other circuit elements on the PCB.

SUMMARY OF THE INVENTION

The present invention provides a printed dual dipole antenna, which can be fit into a limited region on a printed circuit board (PCB), so that the antenna dimension remains small but can be operated in an acceptable level.

The present invention provides a printed dual dipole antenna, which is disposed in a specific region with a border on a PCB having a first surface and a second surface. The printed dual dipole antenna comprises a first split dipole antenna along a first operation direction. The first split dipole antenna includes a balun member, a first antenna branch, and a second antenna branch on the first surface of the PCB, and a signal feeding member on the second surface of the PCB. Wherein, at least one of the first antenna branch and the second antenna branch is bent into a bent structure to fit within the specific region, and a second split dipole antenna along a second operation direction. The second operation direction is perpendicular to the first operation direction. The second split dipole antenna includes a balun member, a first antenna branch, and a second antenna branch on the first surface of the PCB, and a signal feeding member on the second surface of the PCB. Wherein, at least one of the first antenna branch and the second antenna branch is bent into a bent structure to fit within the specific region.

In the foregoing printed dual dipole antenna, the balun member of the first split dipole antenna and the balun member of the second split dipole antenna are coupled together.

In the foregoing printed dual dipole antenna, the invention further comprises a switching device to select one of the first split dipole antenna and the second split dipole antenna in operation.

In the foregoing printed dual dipole antenna, the bent structures for the bent antenna branches are identical.

In the printed dual dipole antenna, the bent structures for the bent antenna branches are different.

In the printed dual dipole antenna, the bent structures for the bent antenna branches include a bent right angle.

The invention also provides a split dipole antenna, on a printed circuit board (PCB) having a first surface and a second surface. The split dipole antenna comprises a balun member, disposed on the first surface of the PCB. A first antenna branch with a first shape structure, coupled to the balun member on the first surface. A second antenna branch with a second shape structure, coupled to the balun member on the first surface. And, a signal feeding member is disposed on the second surface of the PCB. Wherein at least one of the first shape structure and the second shape structure is bent.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 2:
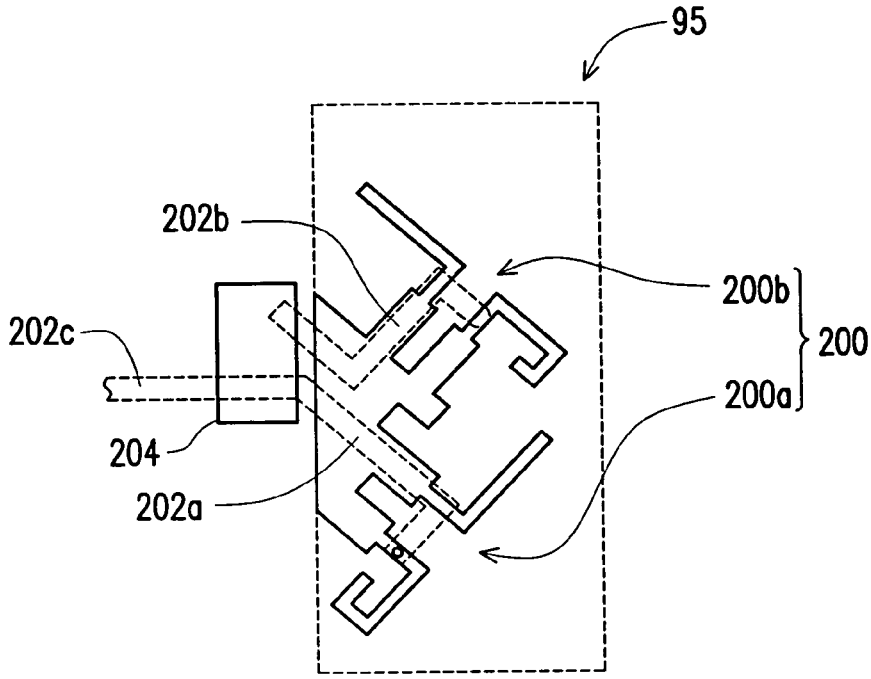
FIG. 2 is a drawing, schematically illustrating a printed dual dipole antenna fit into a limited specific region, according to one preferred embodiment of this invention.

FIG. 2, is a drawing, schematically illustrating a printed dual dipole antenna fit into a limited specific region, according to one preferred embodiment of this invention. In FIG. 2, as previously mentioned, in a wireless communication system, the antenna is formed on the PCB for reducing the apparatus dimension. In some communication interfaces, such as PCMCIA or card bus, two dipole antennas are required for switching between them in use. The antenna size needs to match to a factor of the wavelength of the RF signal. Usually, it is ¼ wavelength. However, if two dipole antennas are formed on the PCB within the antenna area 95. When the size of a wireless communication device, such as the mobile phone, is greatly reduced, the antenna then occupies a relatively large portion of the available area. It is then difficult for the conventional techniques to implement other circuit elements on the PCB.

The invention provides a solution to implement a printed dual dipole antenna 200, which can be fit into a limited area on the PCB. As shown in FIG. 2, in the antenna area 95 of the PCB, two dipole antennas 200*a* and 200*b* form a dual dipole antenna 200. The antenna area 95 is limited to a rather small size. However, the operation condition of ¼ wavelength is, for example, still required to serve as an effective antenna in use at a frequency, such as about 2.4 GHz.

The antenna of the invention is proposed to have at least one antenna branch being bent to fit into the antenna area 95. In FIG. 2, the two antennas 200*a* and 200*b* forming as a printed dual dipole antenna have an included angle and are preferably to be perpendicular to each other. In order to fit the two antennas 200*a* and 200*b* into the antenna area 95, at least one of the antenna branches for one or both antennas 200*a*, 200*b* is bent, such as a right angle. The antenna area 95 usually is a square region or a rectangular region but is not limited to that. The antenna branches are bent, so that the antenna branches do not cross over the border. The balun members for the two split dipole antennas can preferably be coupled together.

In principle, each of the antennas 200*a* and 200*b* can be identical or different. In this example, one branch can remain straight but the length can be optionally cut by a length to ensure the straight antenna branch not crossing the setting border of the antenna area 95. Then, the other branch is then bent. The bent structure preferably includes a right-angle bending portion, wherein one or more bending portion or comers can be included. However, a smooth bending structure can also be used, according to the actual design. Due to the bending structure, the split dipole antenna can be fit into the very limited small space of the antenna area 95 on the PCB.

Figure 3A:
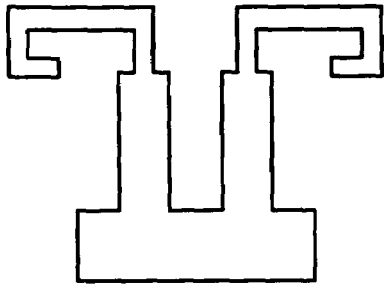
FIGS. 3A–3C are drawing, schematically illustrating some design choices for one split dipole antenna, according to one preferred embodiment of this invention.
Figure 3B:
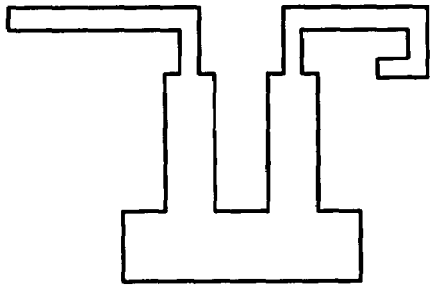
Figure 3C:
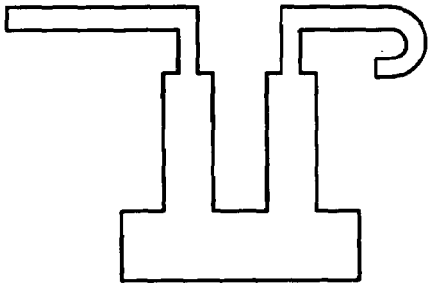

The other dipole antenna 200*b*, in this example, has the operation direction perpendicular to the operation direction of the dipole antenna 200*a*. The dipole antenna 200*b* can use the same design principle as that of the dipole antenna 200*a*. In this example, the two dipole antennas 200*a* and 200*b* have the similar shape but in different length for each portion. The design principle for the dipole antenna of the invention includes at least one branch being bent. In other words, both branches can be bent. FIG. 3A is an example that the both branches are bent in right angle, and the two branches can be symmetrical or asymmetrical. The bent shape can have various options. FIG. 3B and FIG. 3C show other design choices. It is not absolutely necessary to be bent by a right angle. The bent shapes for the two branches are not necessary to be similar. In general, at least one branch of the dipole antenna is bent. However, the bending shape is not limited to a specific geometric shape. The bending shape can include a bending angle or a smooth bending. The length of the straight branch can also be properly reduced with the acceptable level.

When the two dipole antennas are implemented together, those various choices for each one can be combined. For example, the antenna 200*b* can be replaced by the antenna shown in one of FIGS. 3A-3C.

Figure 1:
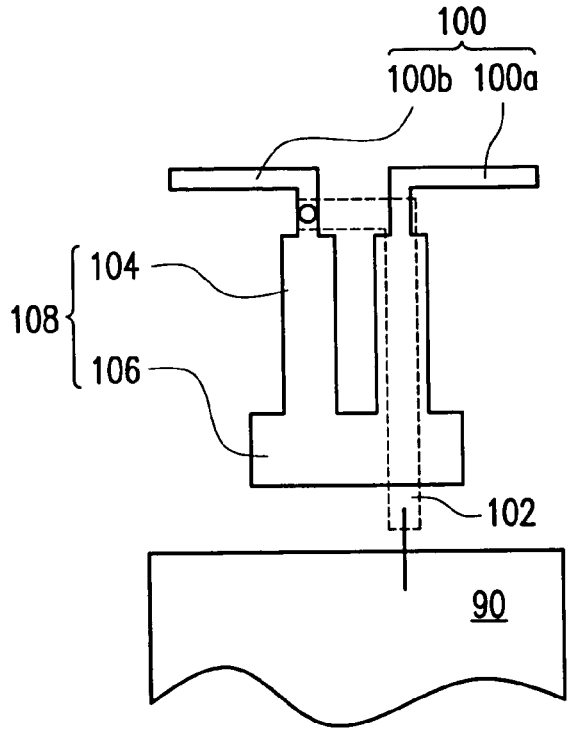
FIG. 1 (PRIOR ART)
FIG. 1 is a drawing, schematically illustrating a conventional T-like dipole antenna is shown from a top view of a PCB.

Referring to FIG. 2 again, the whole dual dipole antenna further includes the conductive strips 202*a* and 202*b*, which are also implemented on the other side of the PCB, respectively coupled to the dipole antennas 200*a* and 200*b*. As also described in FIG. 1, a portion of the conductive strips 202*a*, 202*b* goes along the balun member, and then coupled to one branch. For the design of dual dipole antenna, only one of the split dipole antennas is used at a time. Then, a switching device 204 is included on the PCB. The conductive strip 202*c* can be connected to the selected one of the conductive strips 202*a* and 202*b*, such as the strip 202*a*, by the switching device 204. Then, for example in transmission mode, the RF signal can be fed from the conductive strips 202*c* and 202*a*. Due to the balun design, the signals in unbalance is converted into a balance signal and transmitted by the two branches of the dipole antenna.

Since at least one of the antenna branches is bent, the performance may be affected. In order to verify that the design of antenna by the invention can still be operated as an antenna, the voltage standing wave ratio (VSWR) is calculated with respect to the operation frequency band, such as about 2.4 GHz. For the well known properties, when the value of VSWR is less than 2 with respect to a frequency band, then the antenna is considered to be an acceptable antenna, operated at that frequency band.

Figure 4A:
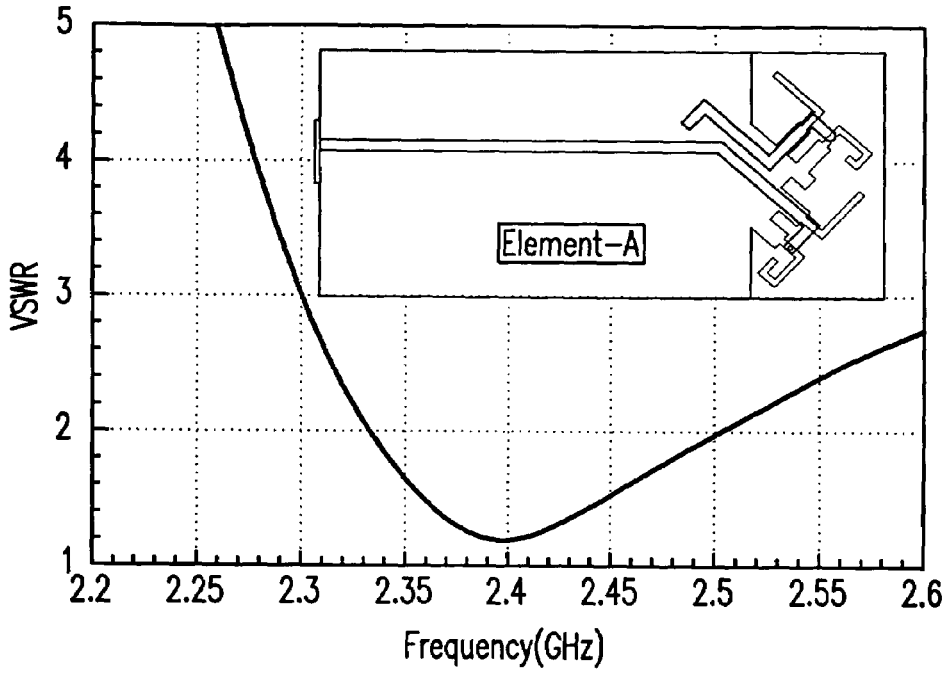
FIGS. 4A–4B are drawings, schematically illustrating two actual designs of the printed dual dipole antenna, and the VSWR quantity to show that the performance of the antenna of the designs are still within the acceptable level, according to one preferred embodiment of this invention.
Figure 4B:
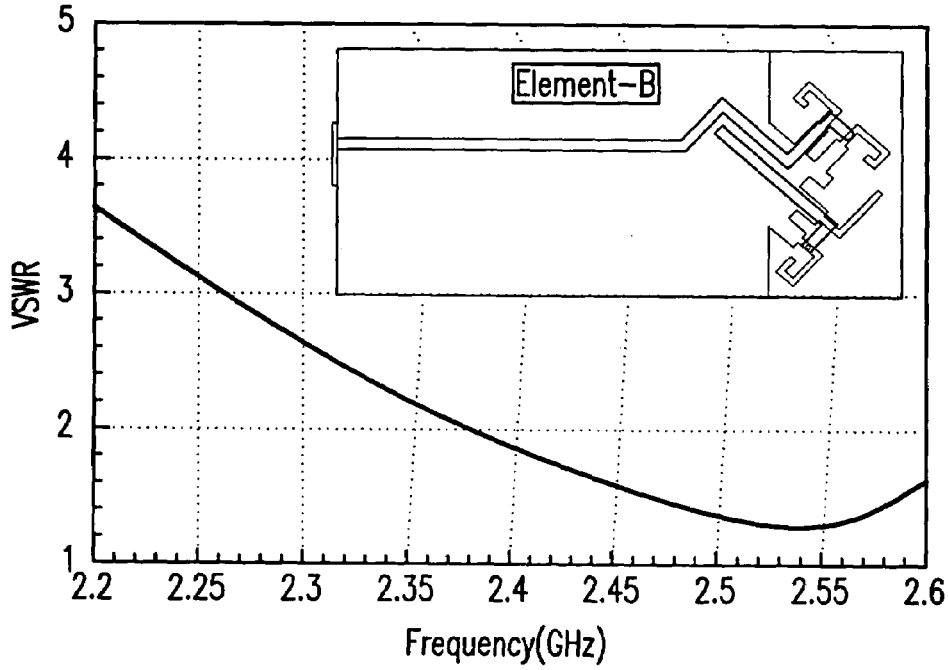

FIGS. 4A–4B shows the measured result for the examples of the actual test designs. In FIG. 4A, the calculation is with respect to the antenna with one straight branch and one bending branch, as shown in FIG. 2. The range of VSWR below 2 has covered the desire frequency band of 2.4 GHz. This means that this kind of design still satisfies the requirement as an effective antenna. Likewise, FIG. 4B shows another design. The VSWR result is with respect to the shape shown in FIG. 3A. If the VSWR is not satisfied, then the antenna branch can be adjusted to other shape. The results from FIGS. 4A–4B indicates that, if the operating frequency band is a narrow band, then the antenna can be designed with bent antenna branches. However, if the antenna is desired to be operated in a broadband, the design of bent antenna branch can still be applied.

According to the investigation of the invention, the bending antenna branch of the dipole antenna is acceptable in use. This is very helpful to implement the dipole antenna into a limited space.

What is claimed is:

1. A printed dual dipole antenna, disposed in a specific region with a border on a printed circuit board (PCB) having a first surface and a second surface, the printed dual dipole antenna comprising:

a first split dipole antenna along a first operation direction, wherein the first split dipole antenna includes a balun member, a first antenna branch, and a second antenna branch on the first surface of the PCB, and a signal feeding member on the second surface of the PCB, wherein at least one of the first antenna branch and the second antenna branch is bent into a bent structure to fit within the specific region; and a second split dipole antenna along a second operation direction, which is perpendicular to the first operation direction, wherein the second split dipole antenna includes a balun member, a first antenna branch, and a second antenna branch on the first surface of the PCB, and a signal feeding member on the second surface of the PCB, wherein at least one of the first antenna branch and the second antenna branch is bent into a bent structure to fit within the specific region.

2. The printed dual dipole antenna of claim 1, wherein the balun member of the first split dipole antenna and the balun member of the second split dipole antenna are coupled together.

3. The printed dual dipole antenna of claim 1, further comprising a switching device to select one of the first split dipole antenna and the second split dipole antenna in operation.

4. The printed dual dipole antenna of claim 1, wherein at least one of the antenna branches of the first split dipole antenna and the second split dipole antenna is cut by a length to fit into the boarder of the specific region.

5. The printed dual dipole antenna of claim 1, wherein the bent structures for the bent antenna branches are identical.

6. The printed dual dipole antenna of claim 1, wherein the bent structures for the bent antenna branches are different.

7. The printed dual dipole antenna of claim 1, wherein the bent structures for the bent antenna branches include a bent right angle.

8. The printed dual dipole antenna of claim 1, wherein the bent structures for the bent antenna branches include two corners bent by a right angle.

9. The printed dual dipole antenna of claim 1, wherein the bent structures for the bent antenna branches include a smooth bending structure.

10. The printed dual dipole antenna of claim 1, wherein the specific region is a rectangular region or a square region.

11. The printed dual dipole antenna of claim 1, wherein in the first split dipole antenna, when one of the antenna branches is bent, the other one of antenna branches remains straight and is optionally cut by a length.

12. A split dipole antenna, on a printed circuit board (PCB) having a first surface and a second surface, the split dipole antenna comprising:

a balun member, disposed on the first surface of the PCB;

a first antenna branch with a first shape structure, coupled to the balun member on the first surface;

a second antenna branch with a second shape structure, coupled to the balun member on the first surface; and a signal feeding member, disposed on the second surface of the PCB, wherein one of the first shape structure and the second shape structure is further bent, so that the two shape structure are different.

13. The split dipole antenna of claim 12, wherein the at least one of the first shape structure and the second shape structure is bent, including a right angle.

14. The split dipole antenna of claim 12, wherein the at least one of the first shape structure and the second shape structure is bent at two corners by a right angle.

15. The split dipole antenna of claim 12, wherein the at least one of the first shape structure and the second shape structure is bent, including a smooth bending structure.

16. The split dipole antenna of claim 12, wherein the first shape structure and the second shape structure are both bent into a bent structure.

17. The split dipole antenna of claim 16, wherein the bent structure comprises a right-angle bending structure.

18. The split dipole antenna of claim 16, wherein the bent structure comprises a smooth bending structure.

19. The split dipole antenna of claim 12, wherein the other one of the first shape structure and the second shape structure is in a straight shape.

* * * * *